United States Patent [19]

Hamilton

[11] 4,149,909

[45] Apr. 17, 1979

[54] IRON PHOSPHATE ACCELERATOR

[75] Inventor: Andrew J. Hamilton, Philadelphia, Pa.

[73] Assignee: Amchem Products, Inc., Ambler, Pa.

[21] Appl. No.: 866,051

[22] Filed: Dec. 30, 1977

[51] Int. Cl.[2] ..... C23F 7/10

[52] U.S. Cl. ..... 148/6.17; 148/6.15 R

[58] Field of Search ..... 148/6.15 R, 6.15 Z, 148/6.17

[56] References Cited

U.S. PATENT DOCUMENTS

| | | | |
|---|---|---|---|
| 2,298,280 | 10/1942 | Clifford et al. | 148/6.15 R |
| 2,657,156 | 10/1953 | Hyams et al. | 148/6.15 R |
| 2,702,768 | 2/1955 | Hyams et al. | 148/6.15 R |
| 2,743,204 | 4/1956 | Russell | 148/6.15 Z |
| 2,758,949 | 8/1956 | Ley et al. | 148/6.15 R |
| 3,015,594 | 1/1962 | Russell | 148/6.15 Z |
| 3,615,912 | 10/1971 | Dittel et al. | 148/6.15 R |
| 3,839,099 | 10/1974 | Jones | 148/6.15 R |

*Primary Examiner*—Ralph S. Kendall

*Attorney, Agent, or Firm*—Robert C. Brown

[57] ABSTRACT

A combination of accelerators, including an oxidizing agent such as a chlorate or a bromate, in conjunction with a reducing agent, particularly, hydroxylamine sulfate is used in phosphatizing ferrous metal at low temperature to produce an iron phosphate coating with good salt spray resistance.

8 Claims, No Drawings

IRON PHOSPHATE ACCELERATOR

FIELD OF THE INVENTION

This invention pertains to a process for producing iron phosphate coatings on the surface of metals, particularly, ferrous metals and to compositions for producing such coatings. The phosphate coating compositions are of the alkali metal phosphate type, that is, coating compositions in which the phosphate in the coating solution is present as dissolved alkali metal phosphate and there is no dissolved metal which forms any substantial portion of the coating. Such coating compositions are utilized primarily in the fabricated metals industry where light-weight coatings are desired in order to facilitate bending and working of the metal and where the anti-corrosion requirements are less stringent. Phosphate coating processes employing this type composition are generally operated at temperatures in the range of about 140° F. to 180° F. at a pH in the range of about 4.2 to about 5.8.

Phosphate coating compositions which are claimed to operate at even lower temperatures are known but have not been found generally satisfactory. Such coating solutions are usually applied by spray to develop coatings of about 50 mg per sq. ft. in periods of time of about 1 to about 3 minutes.

Accelerators such as chlorates, bromates, nitrates and other oxidizing agents are employed where heavier coating weights or shorter coating times are desired.

Iron phosphate coatings are usually applied in five stage systems comprising: (1) alkaline cleaning; (2) water rinse; (3) coating; (4) water rinse; and, (5) final rinse with reduced chrome or partially reduced chrome. Three stage coating systems are also in common use. In such systems the cleaning and coating operations are combined into a single step by incorporating cleaning agents into the phosphate coating bath. Phosphate coating compositions which incorporate as cleaning agents organic solvents, such as kerosence, tetrahydronapthalene, ethyl benzoate and the like, along with emulsifying agents or surfactants and other additives to control foaming or to handle specific cleaning problems generally utilize reducing agents as accelerators. Hydroxylamine salts are known for use in such combined cleaning and coating compositions. Where such compositions are utilized to simultaneously clean and coat ferrous surfaces, it is frequently the cleaning requirement that controls the operative temperatures at which the bath is maintained for the spray process. Generally, in order to achieve effective cleaning of the metal surface, the temperature of the bath must be maintained at about 140° F. or higher.

In recent years with increased cost of energy, there has been renewed emphasis on the use of lower temperature processes for producing iron phosphate conversion coatings. This has led to a search for better accelerator systems for use with iron phosphate compositions to achieve effective coatings with good corrosion resistance at lower temperatures. Among the accelerators generally employed, the chlorates and bromates are generally regarded as the preferred low temperature accelerators. These, as well as the other oxidizing agents used as accelerators, are believed to function by depolarizing hydrogen formed by the action of phosphoric acid on the ferrous surface and to convert the ferrous ion passing into solution to ferric ion in order to avoid rapid build-up of ferrous ion with consequent loss in coating quality. The conversion of ferrous to ferric ion results in the precipitation of the less soluble ferric form which must be periodically removed as sludge.

The formation of the insoluble ferric salt causes further dissolution of the acid phosphate in the coating solution resulting in even more vigorous attack on the surface and a more rapid coating formation. The mode of action of the reducing agent accelerators is not fully understood though generally they are used to accelerate coating formation where the rapid creation of sludge is a problem and must be minimized. Both the reducing agents and oxidizing agents are used at about the same pH range; namely, between about pH 4.5 and 5.8.

While the literature and patent references indicate relatively broad operable pH ranges, in practice, it is desirable to maintain the pH of the working bath within a very narrow pH range in order to obtain consistent coating quality. The usual operating pH in practice is between about 5.0 and 5.5. At this pH the low temperature coating processes such as the chlorate accelerated iron phosphates are not entirely reliable and bare spots are often encountered in operation with such systems.

The oxidizing agents which are employed for low temperature iron phosphate coating formation are not employed in combination with cleaning compositions, since as noted previously, the cleaning requirement is generally for higher temperatures and the oxidizing agents tend to increase the sludge formation. Nor is it known to use a combination of oxidizing agent and reducing agent accelerators though there are broad statements concerning accelerator combinations in the literature.

PRIOR ART

The use of hydroxylamine, specifically, hydroxylamine hydrochloride as an accelerator was first described in U.S. Pat. No. 2,702,768 and compositions utilizing hydroxylamine accelerators are available, particularly the clean and coat variety. Hydroxylamine phosphate used as a reducing rinse following an acid phosphate coating is disclosed in U.S. Pat. No. 2,928,762.

Oxidizing agents for use as accelerators in iron phosphate coating compositions are well known. The use of chlorate to provide a light coating at a temperature of about 160° F. is disclosed in Canadian Pat. No. 557,727. The use of bromate instead of chlorate enabling the bath to be operated at a temperature as low as 125° F. is disclosed in British Pat. No. 884,954. U.S. Pat. No. 3,726,720 discloses a composition and process for preparing iron phosphate coatings at even lower temperatures, i.e. in the range of 90° to 110° F. However, the coating composition for operation at these low temperatures incorporates a fluorine complex in addition to oxidizing accelerators such as nitrates, nitrites, chlorates or peroxides and combinations thereof which may be used. Chlorate accelerated iron phosphate coatings are also disclosed in British Pat. No. 714,321 which operates at about 140° F. and a pH in the range of 4.2 to 5.8 with the single example given operating at a pH of 5.3.

The clean and coat iron phosphate compositions are disclosed, for example, in U.S. Pat. No. 2,744,555 which uses a pH in the range of 3.5 to 5.8 at a temperature of about 150° to 170° F. In the single example given the pH is in the range of 5.3 and there is indication that when the coating solution does not contain emulsified solvents, pH must be lower than a pH of 4.5. Thus, whereas the use of hydroxylamine salts in iron phosphate coating compositions is known and the use of oxidizing accelerators for low temperature operation is also known, the use of an oxidizing agent in combination with a reducing agent accelerator, particularly, hydroxylamine sulfate was not previously known. The general practice has been to select as accelerator either an oxidizing agent or combination of oxidizing agents or else a reducing agent or combination of reducing agents depending upon the particular requirement of the coating process and the specific benefits provided by these separate types of accelerators. The two have not been previously regarded as complementary. It is therefore surprising to find that the combination, in accordance with the present invention, provides the capability of producing improved coatings or lower temperatures.

Accordingly, it is an object of this invention to provide a novel iron phosphate accelerator combination of increased effectiveness for operation at low temperatures. It is a further object of this invention to produce a novel accelerated phosphatizing bath and concentrates for producing such bath. It is yet a further object of this invention to provide a low temperature process for producing relatively heavier iron phosphate conversion coatings on ferrous surfaces to impart improved corrosion resistance thereto. These and other objects will become more clear from the description of the embodiments of this invention which follows.

SUMMARY OF THE INVENTION

A high quality iron phosphate conversion coating of moderate coating weight is developed on ferrous metal surfaces by a spray applied sodium acid phosphate solution employing a combination accelerator comprising hydroxylamine sulfate and an oxidizing agent such as a chlorate or a bromate. In one specific embodiment the preferred accelerator combination is sodium chlorate and hydroxylamine sulfate in a ratio of about 4 parts by weight of sodium chlorate to 1 part by weight of hydroxylamine sulfate. The coatings are formed by spray application of a coating solution having a sodium acid phosphate concentration of about 4% by weight and a total chlorate/hydroxylamine accelerator concentration of about 0.4% by weight. The solution is applied at a bath temperature of between 90° F. and 130° F. in a conventional five stage spray treatment employing an alkaline cleaner and a partially reduced chrome final rinse. The treated metal is preferably dried at a temperature of about 250° F. to about 350° F. for a period of about 5 to about 10 minutes. The conversion coatings produced at low temperatures in accordance with this invention have unusually good salt spray resistance. Coatings of equivalent coating weight and salt spray resistance cannot be obtained by the use of either type accelerator alone.

DESCRIPTION OF THE PREFERRED EMBODIMENTS

The accelerated phosphatizing compositions of this invention contain as essential ingredients an alkali metal phosphate usually the monosodium acid phosphate prepared by combining phosphoric acid with soda ash, to which is added an accelerator combination to provide chlorate or bromate ion and hydroxylamine. The hydroxylamine is added to the composition as hydroxylamine sulfate. The chlorate and bromate ion are preferably supplied by adding the sodium salts to the solution. The essential ingredients can be formulated as a premixed concentrate suitable for making up the treatment bath by simply diluting with water, or one or more of the ingredients may be added separately to the bath at make-up. The composition is generally used for make-up of a bath to be applied in a five-stage phosphatizing operation. It can also be used in a three stage operation by combining cleaning ingredients into the phosphatizing bath.

In accordance with the invention, there is provided a single make-up concentrate with shelf life of at least about one week which when diluted to application concentration has an even longer shelf life, even if the bath remains unworked. Optionally, the bath components can be provided in two or more separate packages combined at make-up. Any suitable phosphate can be utilized, particularly, the alkali metal phosphates. Sodium is preferred because of its ready availability. Where the composition is to be utilized in a three stage operation, there may be added to the concentrate or to the bath at make-up suitable cleaner ingredients such as surfactants, for example, the anionic, cationic or nonionic surfactants and mixtures of such surfactants. The surfactants chosen should be resistant to acid and oxidizing agents. Generally, if surfactant is incorporated into the phosphate coating composition, it is present in about 1 to 10% by weight of the concentrate and is preferably there in sufficient amount to provide about 0.01% by weight preferably at least about 0.05 to 0.1% by weight in the coating bath. Other components such as sodium bisulfate etc. are also included.

The surfactant combination should include specifically a low foaming surfactant and other ingredients which will be suited to the particular metal substrate to be cleaned. Generally, however, the combined accelerator of this invention is intended to be used in alkaline metal phosphate treatments of the five stage type, that is, where the cleaning operation precedes the phosphate conversion coating operation. In such instances, the cleaners preferred are the strong alkaline cleaners which produce a clean, oil, rust and scale free metal surface which provides optimum coating results. Suitable cleaners are available for example as concentrates containing about 30% by weight caustic soda. Silicate cleaners may also be used. Among the surfactants that can be suitably employed in the cleaning operation the nonionic surfactants are preferred. Examples of suitable surfactants are those available under the brand names of Makon, Plurafac, Tergitol, Triton and Surfonic. The coating can be conveniently applied through conventional power spray equipment, though dip, flow coat and other conventional application processes can also be employed. The concentration of the coating composition in the bath will be varied depending upon the type of application and particularly the contact time. Where spray processes are employed, suitable compositions can be formulated which enable the development of an excellent coating in one minute contact time.

The bath once it has been made up is easily maintained by replenishing with additional amounts of the same concentrate with addition of acid or caustic to control alkalinity and acidity. The operation of the bath is maintained by monitoring several control parameters, most important of which are, the pH, alkalinity, the total acidity and free acidity. By free acidity is meant the number of milliliters of 1/10 normal sodium hydroxide (points) required to neutralize a 10 mil sample of the solution to a bromo-phenol-blue end-point. By total acidity is meant the number of mils of 1/10 normal sodium hydroxide (pointage) needed to neutralize a 10 mil sample of the solution to a phenolphthalein end-point. By alkalinity is meant the number of mils of 1/10 normal sulfuric acid or hydrochloric acid (points) needed to titrate a 10 mil sample of the solution to a brom-cresol-green end-point.

Generally, the coating baths used in the phosphatizing process of this invention are made-up at the plant site by dissolving in water a premixed concentrate with all of the bath components present. Such concentrates contain sodium acid phosphate prepared by blending phosphoric acid with the stoichiometric amount of sodium carbonate and adding the accelerators and such optional ingredients as coloring agents and the like. Suitable concentrates are formulated to contain between about 0.25 and 0.5 parts by weight preferably about 0.4 parts by weight of sodium chlorate and between about 0.05 and 0.25 part by weight preferably about 0.1 part by weight of hydroxylamine sulfate for each part by weight of sodium acid phosphate. If desired one or both of the accelerator components can be provided separately and combinations of oxidizing agent accelerators particularly chlorate and bromate can be used either by incorporating both into the concentrate or adding either one or both separately.

Whether provided separately or added to the concentrate the accelerator combination is used in amounts such that the ratio of hydroxylamine sulfate to oxidizing agent accelerator is such that the coating bath contains between about 0.2 and about 5 parts by weight of oxidizing agent, preferably chlorate, for each part by weight of hydroxylamine sulfate. Preferably the amount of chlorate or similar accelerator is used in an amount greater than the amount of hydroxylamine sulfate and preferably in a ratio of about 2 to 5, suitably 4, parts by weight of sodium chlorate for each part by weight of hydroxylamine sulfate. The total amount of chlorate and hydroxylamine should be such as to provide in the bath at make-up a concentration of total accelerator of at least about 0.2% by weight and preferably between about 0.4% and 0.8% by weight. Greater amounts can be used though the advantages of substantially greater amounts are not correspondingly greater. A typical coating bath utilizing the accelerator combination of this invention is made up by adding to the bath sufficient concentrate to provide about 5 to about 20 grams per liter of sodium acid phosphate and preferably about 7.5 to about 15 grams per liter; about 3.0 to about 12 grams per liter of sodium chlorate, preferably about 5 to about 10 grams per liter; and about 0.75 to about 3 preferably about 1.5 to 2 grams per liter of hydroxylamine sulfate. The bath can also be conveniently controlled by use of electronic control devices, particularly, pH meters and redox potential meters. By way of illustration a bath is make up by adding the ingredients either as a preformulated concentrate or separately in amounts sufficient to provide about 15 g/l of sodium acid phosphate; about 6 g/l of sodium chlorate and about 1.5 g/l of hydroxylamine sulfate. The control parameters are measured by titration and adjusted by addition of acid or caustic as necessary. The essential control points for operating the bath are total acidity, alkalinity, temperature, spray time and nozzle pressure. The total acidity (pointage) should be maintained between about 4 to 12 preferably between about 6 and 8. If the total acidity drops below about 6, it can be adjusted upward by addition of more make-up concentrate. If the total acidity is high, it will generally be decreased as the bath is operated. The operating alkalinity range (points) is between about 0.1 and about 1.0 and preferably between about 0.4 and about 0.7. Alkalinity is controlled by addition of sufficient amounts of caustic if low or phosphoric acid if high. The operating pH should be maintained between about 4.5 and 5.5 and preferably between about 5.0 and 5.5. If the pH is low, it can be raised by addition of sodium hydroxide or sodium carbonate solution. If it is high it can be lowered by addition of phosphoric acid. In making up the bath the control parameters and particularly pH may be affected by the acidity or alkalinity of the water. It is preferred to use potable water of about 7 pH, however tap water is generally adequate. Once the bath is made up and adjusted it can be operated by maintaining the level through addition of both components at the same concentration as at make-up with periodic adjustments as necessary to maintain it within the control parameters indicated. Since some sludge (insoluble iron salts) is generated during processing, periodic shut down is required for sludge removal.

The metal such as steel to be coated should be thoroughly cleaned by treating in a first stage with a moderate to harsh alkaline cleaner followed by water rinse; for exceptionally heavily soiled pieces a detergent cleaner can be added in the cleaning stage. The cleaning stage is preferably a power spray at about 20 psig nozzle pressure with the cleaner solution at a temperature of about 140° F. to 180° F. A typical cleaner that can be satisfactorily employed is one prepared by dissolving in about 6 liters of water about 90 to 100 grams of a cleaner composed of about 60% by weight tripolyphosphate; about 20% by weight caustic soda; about 3 to 4% by weight gluconate and the remainder surfactants such as Plurafac A-38, and Makon NF-12. A low temperature cleaner (140° F. or lower) is preferred in order to further conserve energy.

Following the cleaner stage the metal is water rinsed before spray coating. The coating stage uses conventional power-sprayer processing equipment operating at 10 to 20 psig nozzle pressure for a contact time of 1 minute. Shorter or longer contact times can be used depending upon the coating weight desired. The concentration of the bath and temperature can also be varied to change coating time. Generally the coating time for spray application is between about 0.5 to 3 minutes. For dip application the same coating time can be achieved by using approximately double concentration. The temperature of the coating solution is maintained between about 90° F. and about 130° F. preferably between 110° F. and 120° F.

The preferred operating temperature is about 110° F. though the process can be operated at temperatures as low as 90° F. and less. At the lower temperatures some loss of coating weight and coating quality may occur unless spray time or concentration are increased. The preparation of the metal surface before coating and other factors such as concentration of other ingredients in the coating composition and the ratio or amount of accelerator employed all affect the exact choice of temperature which can be easily varied in practice. The accelerator combination of this invention is ordinarily used in amounts such that the chlorate or bromate or combination of chlorate and bromate together with hydroxylamine is present in the coating bath at about 0.6% by weight concentration. However, greater or lower amounts can be utilized.

Following the coating stage the metal is water rinsed in a conventional spray treatment and then treated with a solution of a chromic acid or partially reduced chrome. The final rinse may be heated to about 140° to 160° F. to facilitate drying. The final rinse may be a reduced chrome of the type described in U.S. Pat. Nos. 3,189,489 and 3,063,877. Non-chrome final rinses can also be used. The final rinse is usually at a pH of about 4 to 5. After the final rinse the metal can be air dried before painting though it is preferably oven dried at a temperature of 250° F. to 350° F. for about 5 to 10 minutes. The coated surface provides excellent paint bonding and salt spray resistance. The process is a relatively low sludge producing operation apparently providing the reducing agent accelerator advantage of reduced sludge and also the increased coating weight and shorter coating time of an oxidizing agent accelerator with the added benefit of better salt spray resistance. While the process has shown best results on mild steel it can be used to coat various ferrous alloys particularly steel cabinets, furniture, lighting fixtures, appliances and the like. Where the phosphatized metal is to be painted with electrocoat, it is preferred to add a final rinse with deionized water following the chrome rinse in the five stage process.

While not intending to be bound by any particular theory, it is believed that the particular effectiveness of the accelerator combination of this invention is achieved from the increased rate of metal attack by phosphoric acid in the bath, brought about by the presence of oxidizing agents, while simultaneously achieving a valence balance between the ferrous and ferric form of the iron ion present in the bath as a consequence of the presence of the reducing agent, hydroxylamine sulfate. It is believed that the use of the combination accelerator may affect the ferric/ferrous ion equilibrium at the metal interface, favoring the development of a higher quality coating. This would appear to be consistent with the known composition of the iron phosphate coating which is generally regarded to consist of a complex material containing among other things, vivianite which contains iron in both valence states, see for example "Theory and Practice of Phosphating" by Edward A. Rodzewich from the Educational Series sponsored by the American Electroplaters Society. In any event, the observed improvement in coating weight and coating quality obtained by using the accelerator combination indicates a synergistic effect, whether complementary or stepwise. The combination allows for the development of a coating of significantly improved salt spray resistance at a lower temperature than could be obtained with the use of either accelerator alone. Coating weights in the range of 30 to 50 mg per $ft^2$ are readily obtained at about 100° F. in one minute contact time at concentrations of about 4% by weight sodium acid phosphate and about 0.6% by weight of the combined accelerator. The invention also contemplates addition of the readily soluble hydroxylamine to any conventional chlorate accelerated iron phosphate coating process. Significant improvement in coating weight and salt spray resistance can be expected in any chlorated accelerated iron phosphate operation by adding hydroxylamine sulfate in a concentration of about 0.05 to 5% by weight in the working bath. Similarly iron phosphate processes utilizing hydroxylamine as accelerator can be improved by addition of chlorate or bromate in accordance with this improved phosphatizing process.

The invention will be more fully understood from the following examples which are given by way of illustrating the process and are not to be considered as limiting the invention.

EXAMPLE 1

A concentrated phosphating composition containing a chlorate accelerator is prepared by mixing the following:

| | lbs. | % weight |
|---|---|---|
| Phosphoric Acid (25% by wgt) | 2.942 | 27.45 |
| Sodium carbonate | 0.883 | 8.24 |
| Chromic nitrate (color additive) | 0.007 | 0.07 |
| Sodium chlorate | 1.242 | 11.59 |
| Water | 6.009 | 56.08 |

The sodium carbonate is slurried in one-half the formula amount of water and carefully blended with phosphoric acid by slow addition to control the effervescence. The remaining water, the chromic nitrate and sodium chlorate, are mixed with stirring to produce a clear solution having a specific gravity of 1.289.

The concentrate is utilized to prepare a phosphating bath at a concentration of 4% by adding 320 ml. of concentrate to tap water to make up an 8 liter bath. 45 ml. of a caustic soda solution, prepared by adding 2 lbs. of caustic to a gal. of water, is added to the bath. The control parameters for the bath are measured and found to be as follows:

Free Acid 0.5
Total Acid 12.2

In view of the high total acid an additional 15 mls. of caustic soda solution is added. The control parameters measured again are as follows:

Alkalinity 0.8
Total Acid 10.7
pH 5.25

Unpolished Q panels of cold rolled steel measuring 4"×6" are cleaned in a strong alkaline cleaner at about 160° F. and treated with the phosphate solution by spraying the solution heated to about 115° F. for a contact time of one minute using a nozzle pressure of about 20 psig in a laboratory spray machine. The results are as shown in Table I below.

TABLE I

| Panel | Cleaner Temp (° F.) | Phosphate Bath Temp (° F.) | Alkalinity | Total Acid | pH | Coating Weight (mg/sq ft) | Coating Appearance |
|---|---|---|---|---|---|---|---|
| 1 | 160 | 113 | 0.8 | 10.7 | 5.25 | no coating | almost bare |
| 2 | 162 | 115 | 1.0 | 10.2 | 5.46 | " | " |
| 3 | 160 | 115 | 1.1 | 10.3 | 5.54 | thin-almost none | thin and powdery |
| 4 | 160 | 115 | 1.3 | 10.2 | 5.64 | thin | bare spots "windows" |
| *5 | 162 | 115 | — | — | — | " | " |
| 6 | 162 | 115 | — | — | — | " | smaller and less bare area |

TABLE I-continued

| Panel | Cleaner Temp (° F.) | Phosphate Bath Temp (° F.) | Alkalinity | Total Acid | pH | Coating Weight (mg/sq ft) | Coating Appearance |
|---|---|---|---|---|---|---|---|
| 7 | 160 | 112 | 1.3 | 10.3 | 5.56 | " | good coating but thin |
| 8 | 156 | 116 | — | — | — | " | " |
| 9 | 152 | 117 | — | — | — | 15.9 | " |

*After panel #5 was treated an additional 2 ml. of caustic soda solution was added to the bath.

To the above bath there is then added 12.5 grams of hydroxylamine sulfate and 1 ml. of caustic soda to adjust pH. Additional panels are treated with results as shown in Table II below.

TABLE II

| Panel | Cleaner Temp (° F.) | Phosphate Bath Temp (° F.) | Alkalinity | Total Acid | pH | Hydroxylamine Sulfate (% of formula) | Coating Weight (mg/sq ft) | Coating Appearance |
|---|---|---|---|---|---|---|---|---|
| 1 | | | 1.2 | 12.3 | 5.29 | 3.0 | | |
| 2 | 176 | 114 | 1.4 | 12.2 | 5.40 | 3.0 | 24.3 | very good heavier coating |
| 3 | 168 | 116 | | | | " | | " |
| 4 | 164 | 115 | | | | " | | " |
| *5 | 152 | 114 | | | | 3.0 | 24.3 | very good heavier coating |
| **6 | | | 1.2 | 14.0 | 5.15 | 6.0 | | " |
| ***7 | | | 1.6 | 13.6 | 5.25 | " | | " |
| 8 | 167 | 115 | 1.8 | 13.5 | 5.32 | " | | " |
| 9 | 160 | 115 | | | | " | | " |
| 10 | 158 | 115 | | | | " | | " |
| 11 | | | 1.4 | | 5.25 | " | | " |
| 12 | 160 | 110 | 1.1 | 14.5 | 5.04 | " | | " |
| 13 | 165 | 118 | | | | " | | " |

*After panel #5 was coated an additional 12.5 g. of hydroxylamine sulfate was added to the bath.
**After each of panels 6 and 7 there was added 3½ mls and 2 mls respectively of caustic solution to reduce total acid.
***After each of panels 10 and 11 there was added 1 ml and 1.5 ml respectively of phosphoric acid to reduce the alkalinity.

The coatings obtained with hydroxylamine sulfate additions to the phosphating bath demonstrated exceptional salt spray resistance when treated in standard salt spray tests for 96 and 168 hours.

EXAMPLE 2

A phosphating bath is prepared by dissolving in water a sufficient amount of the chlorate accelerated concentrate described in Example 1 to provide a bath having a concentration of 4% (vol/vol) which is then heated to about 120° F. 4"×6" unpolished cold rolled steel Q panels are used in each treatment. Three panels each are painted with Steelcase white paint and three are painted with DuPont Refrigerator White after an iron phosphate coating with % hydroxlamine sulfate as indicated in Table III below. Prior to phosphatizing, the panels are cleaned with a strong alkaline cleaner and water rinsed. The phosphate solution is then spray applied for one minute contact time. After phosphatizing, the panels are water rinsed and dip treated with a reduced chrome final rinse. Following the final rinse the panels are dried at about 250° F. for about eight minutes. After cooling the panels are painted and the paint cured. Each panel is then scribed vertically down to the bare metal. The scribed panels are placed in a conventional salt spray cabinet and subjected to standard salt spray test for 96 hours in the case of the Steelcase paint and 168 hours in the case of the DuPont Refrigerator White. The results are shown in Table III below. Failure is measured from the scribe and given in 32$^{nds}$ of an inch. The results are for three panels in each case.

TABLE III

| Treatment | Coating Weight | % Hydroxylamine Sulfate | pH | Steelcase 96 hour salt spray | DuPont Refrigerator White - 168 hr. salt spray |
|---|---|---|---|---|---|
| A | 15.9 | 0 | 5.56 | 2 to 5; 4 average | 3 to 4; 8 max. |
| B | 24.3 | 3 | 5.40 | trace to 1 max. | trace to 1; 2 max. |
| C | 24.6 | 6 | 5.32 | trace to 1;*1 panel 10 | trace to 1; 3 max. |
| D | 31.8 | 6 | 5.04 | trace to 1; 2 max. | trace to 1; 2 max. |

*This panel showed results inconsistent with the others in the test and is considered to be a "sport".

EXAMPLE 3

This example is for comparison of iron phosphate coatings prepared from the combined accelerator of this invention and from a conventional clean and coat iron phosphate using only hydroxylamine as an accelerator. The test panels are first cleaned in a strong alkaline cleaner and the phosphating composition is spray applied. After phosphatizing, each panel is given a 20 to 30 second dip in a partially reduced chrome final rinse. The clean and coat treatment employed a bath prepared as a 1.5% (wt/vol) concentration of a clean and coat phosphatizing formulation prepared by combining 10.6 grams of hydroxylammonium sulfate with 109.4 grams of an alkali phosphate composition having the following components.

| Ingredient | grams/kg |
|---|---|
| monosodium phosphate | 704 |
| disodium phosphate | 118 |
| Microcel A (calcium silicate) | 26 |
| Makon NF 12 | 10 |
| Plurafac RA43 | 20 |
| Petro 22 | 10 |

The treatment conditions and results are shown in Table IV which follows.

TABLE IV

| Panel | Temp. (° F.) | Total Acid | pH | Spray Time (min) | Coating Weight (mg/ft$^2$) | Coating Appearance |
|---|---|---|---|---|---|---|
| One 4"× 6" unpolished Q panel | 118 | 9.8 | 5.55 | 1 | 20.1 | characteristic blue, sl. |
| " | 120 | | | 2 | 21.0 | " |
| " | 121 | | | 3 | 24.3 | " |
| Six 4"× 12" cold rolled steel panels | 121 | | | 3 | | " |

The treatment according to this invention employed a bath prepared as a 4% concentration of the chlorate accelerated phosphatizing composition described in Example 1 and 0.12% by weight of hydroxylamine sulfate. The results of these treatments are shown in Table V below.

TABLE V

| Panel | Temp (° F.) | Total Acid | Alkalinity | pH | Spray Time (min) | Coating Weight mg/ft$^2$ | Coating Appearance |
|---|---|---|---|---|---|---|---|
| 4"× 6" unposlished Q panel | 121 | 10.8 | 0.4 | 4.95 | 1 | 35.1 | light blue |
| " | 121 | | | | 2 | 47.1 | golden |
| " | 122 | | | | 3 | 55.5 | violet gold |
| Six cold rolled steel panels | 122 | | | | 3 | | " |

EXAMPLE 4

A concentrate for making up coating baths with the accelerator combination of this invention is prepared by combining the following ingredients.

| | grams/liter | % by weight |
|---|---|---|
| Phosphoric Acid (75% by wt) | 346.23 | 26.64 |
| Sodium Carbonate (light soda ash) | 103.92 | 8.00 |
| Chromic Nitrate (50%) | 0.82 | 0.06 |
| Sodium Chlorate | 146.16 | 11.25 |
| Hydroxylamine Sulfate | 38.60 | 2.97 |
| Water | 707.16 | 54.41 |
| | 1342.89 | 103.33 |
| On combining the phosphoric acid and sodium carbonate, there is a loss of carbon dioxide | −43.19 | |
| | 1299.70 | 100.00 |

The soda ash is first slurried in a portion of the formulation water and the phosphoric acid is slowly added to the slurry to control the rate of carbon dioxide evolution which results. The remaining ingredients are added in the order indicated and the mixture is stirred until all ingredients are dissolved. A 1% solution of the concentrate prepared in this manner in deionized water has a pH of 2.70±0.1 at 25° C. and Total Acid of 3.6, i.e., requires 3.5±0.2 ml of 0.1 N sodium hydroxide to titrate to pink with phenolphthalein, specific gravity at 60° F. is 1.303.

The concentrate is sufficiently stable to permit storing for at least one week. After one week the concentrate may react, generating a gas. To prepare a coating solution the concentrate is simply added to water to provide about 4% vol/vol of the concentrate in solution. The bath is heated to about 90° to 130° F. and spray applied.

EXAMPLE 5

A coating bath prepared from the concentrate of Example 4 at 4% vol/vol was held for one week without working. Thereafter cleaned test panels were treated as shown in Table VI below.

TABLE VI

| Panel | Temp (° F.) | Total Acid | pH | Alkalinity | Time (min) | Coating Weight (mg/ft$^2$) | Coating Appearance |
|---|---|---|---|---|---|---|---|
| Unpolished Q panel | 120 | 11.7 | 4.92 | 0.5 | 1 | 37.5 | light blue, sl gold overlay |
| " | 121 | " | " | " | 2 | 60.0 | blue/gold |
| " | " | " | " | " | 3 | 53.1 | red/gold |

I claim:

1. A process for producing an iron phosphate conversion coating on metal surfaces comprising preparing an aqueous solution containing between about 5 and about 20 grams per liter of sodium acid phosphate, between about 3 and about 12 grams per liter of sodium chlorate and between about 0.75 and about 3 grams per liter of hydroxylamine sulfate, maintaining the temperature of said solution between about 90° F. and 130° F. and spraying said solution onto a metal surface for a contact time of about 0.5 to about 3 minutes.

2. A process according to claim 1 wherein said aqueous coating solution also contains a cleaner ingredient comprising one or more anionic, cationic or nonionic surfactants in an amount between about 0.01% and about 0.1% by weight of said aqueous coating solution.

3. A process for producing an iron phosphate coating on the surface of ferrous metal which comprises treating a ferrous metal surface with an alkali metal phosphate coating composition comprising an aqueous solution of about 7.5 to about 15 grams per liter of sodium acid phosphate between about 5.0 to about 10 grams per liter of sodium chlorate and about 1.5 to about 2 grams per liter of hydroxylamine sulfate.

4. A process according to claim 3 wherein the operating pH of said composition is maintained between about 4.5 and about 5.5.

5. A process according to claim 4 wherein the coating composition is applied to the metal surface by spraying at a nozzle pressure between 10 and 20 psig for a contact time between about 0.5 and 3 minutes with the temperature of the coating solution maintained between about 90° F. and about 130° F.

6. The process according to claim 5 wherein the metal surface is treated with the coating solution so as to produce a coating of 30 to 50 mg. per ft. square.

7. In a process for producing an iron phosphate coating on the surface of ferrous metal by treating a ferrous metal surface with an aqueous alkali metal phosphate composition; the improvement which comprises adding a combination accelerator consisting essentially of hydroxylamine sulfate and an oxidizing agent accelerator such that the total amount of accelerator present is between about 0.2% and about 0.8% by weight of the total alkali metal phosphate composition, and the ratio of hydroxylamine sulfate to oxidizing agent accelerator is between about 0.2 and about 5 parts by weight of oxidizing agent for each part by weight of hydroxylamine sulfate.

8. A process for producing an iron phosphate coating on the surface of ferrous metal which comprises treating a ferrous metal surface with an aqueous coating solution consisting essentially of about 15 grams per liter of sodium acid phosphate, about 6 grams per liter of sodium chlorate and about 1.5 grams per liter of hydroxylamine sulfate and maintaining the pH of said coating solution between about 4.5 and about 5.5.

* * * * *